US007677475B2

(12) United States Patent
Lawyer

(10) Patent No.: US 7,677,475 B2
(45) Date of Patent: Mar. 16, 2010

(54) WEIGHTED SPRINKLER HEAD APPARATUS

(75) Inventor: Jerry D. Lawyer, Clermont, FL (US)

(73) Assignee: Senninger Irrigation Inc., Clermont, FL (US)

( * ) Notice: Subject to any disclaimer, the term of this patent is extended or adjusted under 35 U.S.C. 154(b) by 0 days.

(21) Appl. No.: 12/157,122

(22) Filed: Jun. 9, 2008

(65) Prior Publication Data

US 2009/0302137 A1 Dec. 10, 2009

(51) Int. Cl.
*B05B 1/26* (2006.01)

(52) U.S. Cl. ..... 239/523; 239/222.11; 239/524; 239/600; 239/734

(58) Field of Classification Search ..... 239/222.11, 239/222.17, 222.21, DIG. 11, 600, 723, 726, 239/734

See application file for complete search history.

(56) References Cited

U.S. PATENT DOCUMENTS

| | | | | |
|---|---|---|---|---|
| 3,171,652 | A | 3/1965 | Newman | |
| 3,226,117 | A | 12/1965 | Walklet | |
| 6,382,525 | B1 | 5/2002 | Santiesteban et al. | |
| 6,808,135 | B1 | 10/2004 | Landry | |
| 6,811,098 | B2 * | 11/2004 | Drechsel | 239/222.11 |
| 6,932,279 | B2 * | 8/2005 | Burcham | 239/222.17 |
| 6,997,406 | B2 | 2/2006 | Nelson et al. | |

* cited by examiner

*Primary Examiner*—Steven J Ganey
(74) *Attorney, Agent, or Firm*—William M. Hobby, III

(57) ABSTRACT

The present invention relates to an irrigation sprinkler head having a removable weighted collar thereon. The sprinkler head has a tapered water inlet for wedging a weighted collar having a matching tapered opening therethrough.

7 Claims, 2 Drawing Sheets

WEIGHTED SPRINKLER HEAD APPARATUS

BACKGROUND OF THE INVENTION

The present invention relates to sprinkler heads and especially to a sprinkler head having a removable weighted collar.

Mechanically moved irrigation systems are commonly used throughout the United States for irrigating agricultural lands. Generally, the mechanically moved irrigation systems include a plurality of wheeled towers supporting a linear water conduit in a manner that the wheeled towers and water conduit can be moved through an agricultural field for changing the position of irrigation sprinklers coupled to the water conduit. One end of the water conduit is coupled to a water main or well and sprinkler heads are mounted in spaced alignment along the water conduit between the wheeled towers. The irrigation system may be moved in an agricultural field by a motor coupled through a gear box to the wheels of the towers.

One type of mechanically moved irrigation system in common use is a center pivot irrigation system used in the irrigation of large fields. These typically are comprised of a linear water conduit which is pivotally connected at one end to a source of water under pressure. The water conduit is carried in an elevated position by a plurality of spaced wheeled towers which are powered by hydraulic, pneumatic or electric motors to rotatably sweep the central conduit over a central pattern in a field. The central conduit includes a plurality of water sprinkling heads spaced over its length for distributing a spray of water on the circular field area as the center pivot irrigation conduit passes thereby. The center pivot and other wheeled line irrigation systems have been successful for uniform distribution of water over a field crop.

The current practice in these irrigation systems is to connect drop hoses to the water main with conventional couplings and then have the hoses drop near the field below and have sprinklers attached to the end thereof for distributing the water adjacent the crops.

Prior U.S. patents using weighted collars can be seen in Applicant's prior U.S. patent to Santiesteban et al., U.S. Pat. No. 6,382,525, which is a sprinkler head with a shielded weighted collar used to reduce vibrations and to deflect water from a sprinkler head while shielding the sprinkler head from physical damage. The Landry U.S. Pat. No. 6,808,135 is for a fluid-filled weight, particularly suited for use in irrigation systems. The Nelson et al., U.S. Pat. No. 6,997,406, is for a hose weight with ballast for use in an irrigation drop tube system and includes an elongated hollow core sleeve. The prior U.S. Patent to M. D. Walklet, U.S. Pat. No. 3,226,117, is a bar bell disk weight construction having hollow weights for filling with a fluid material as does the J. W. Newman, U.S. Pat. No. 3,171,652, for an exercising weight filled with solidifying material.

One of the problems that occurs with sprinkler heads is sprinkler movement from the wind which can result in wear and premature failure of a sprinkler head. The present invention holds the sprinkler head down and prevents it from blowing around and at the same time forms a collar which continuously maintains a snug fit on the sprinkler head to prevent movement between the weight and the sprinkler head to prevent wear and damage from the movement of the weight on the sprinkler head.

SUMMARY OF THE INVENTION

The present invention relates to a sprinkler head having a removable weighted collar thereon. The sprinkler head body has an upper body portion having an elongated tapered water inlet having a water passageway therethrough. The tapered body portion also has a nozzle for directing water from the water inlet while the sprinkler head body lower body portion has at least one arm extending therefrom. A weighted collar has a tapered bore therethrough with the taper being sized to fit over the elongated taper water inlet to wedge thereon. The weighted collar is thus prevented from moving relative to the sprinkler head body water inlet due to vibration and movement of the sprinkler head. The weighted collar has a hollow interior which can be filled with any material for adding weight to the collar but granular magnetite is one preferred material. The elongated water inlet has a threaded end portion for attaching a water supply and may be either removably attached to the sprinkler head or formed as part of the sprinkler head body. The weighted collar bore taper is sized to ride on the water inlet taper to thereby allow continuing wedging thereon from the vibration of the sprinkler head allowing the weigh to settle down further on the taper and preventing movement of the weight relative to the sprinkler head.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
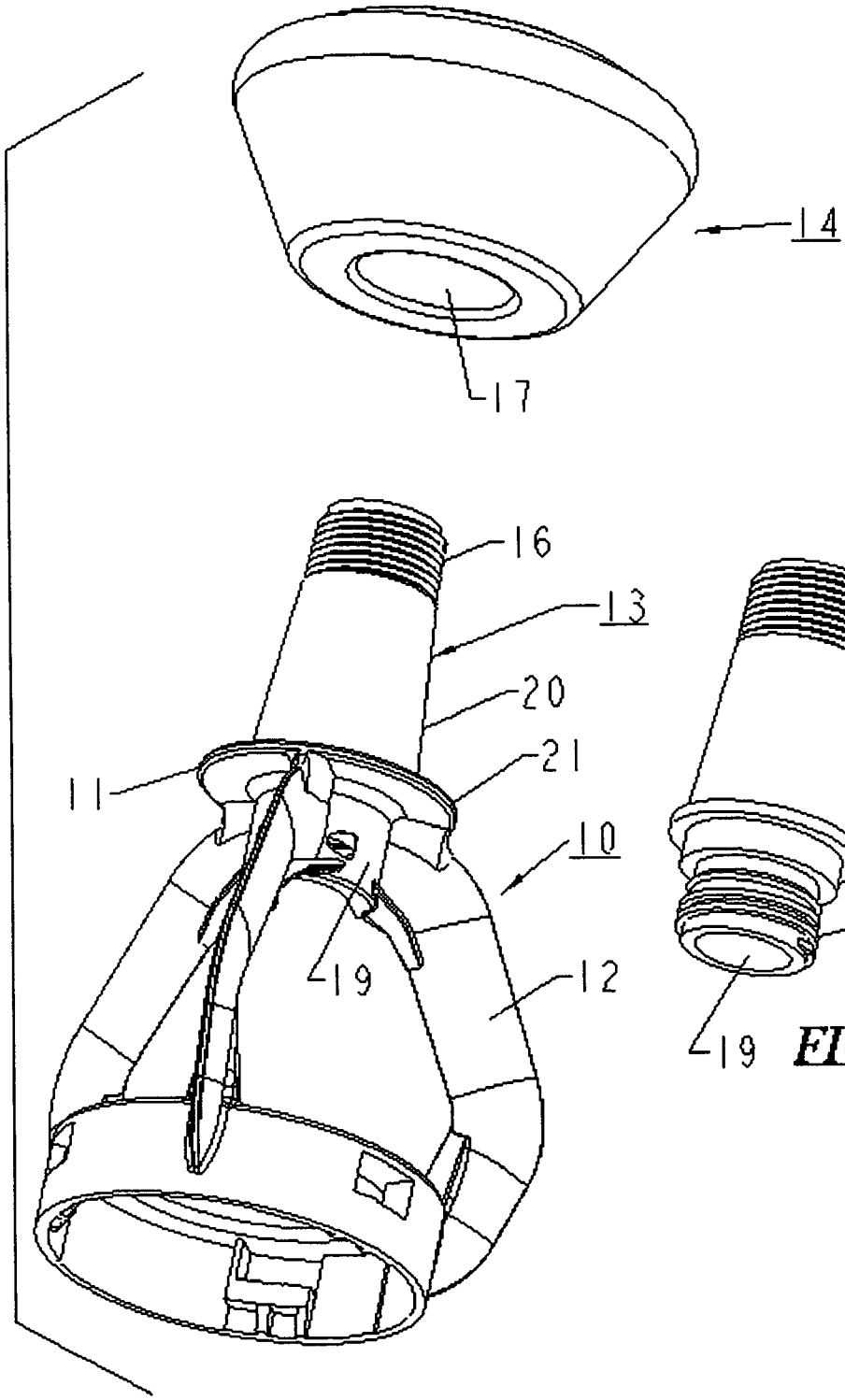
FIG. 1 is an exploded view of the sprinkler body and weighted collar of the present invention.
Figure 2:
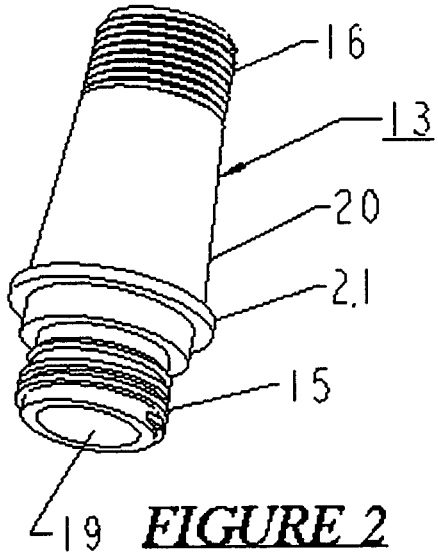
FIG. 2 is a perspective view of the tapered water inlet collar support of FIG. 1.

Referring to the drawings, FIGS. 1 through 4, a sprinkler body 10 can be seen having an upper body portion 11 having a plurality of arms 12 extending downward therefrom. The upper body has a nozzle portion 19 and has an elongated tapered water inlet 13 which is also the tapered support for the weighted collar 14. The elongated water inlet and weight support, as shown in FIG. 2, has a threaded attachment 15 for attaching to the sprinkler body 11. It should be clear, of course, that this part can be molded into the sprinkler head 10. The elongated tapered water inlet 13 also has a threaded portion 16 for attaching to the drop hose of a central irrigation system.

Figure 3:
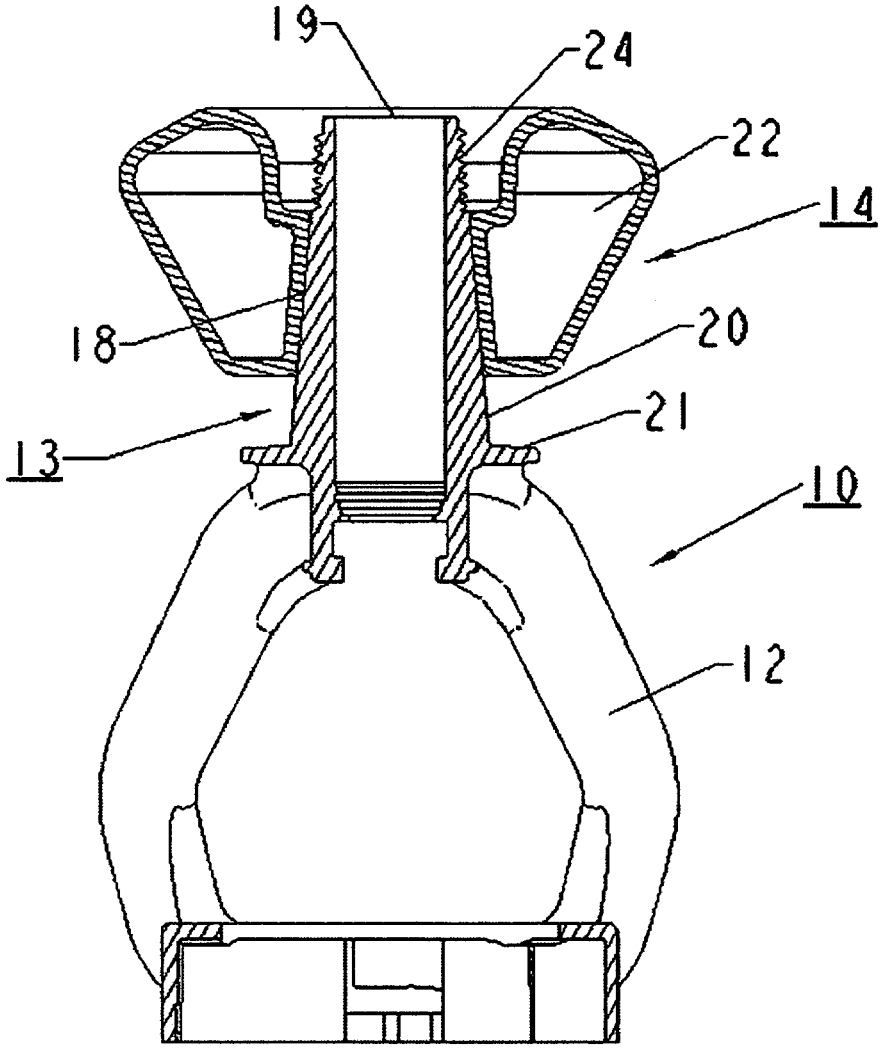
FIG. 3 is a sectional view taken through the sprinkler head having the weighted collar attached.
Figure 4:
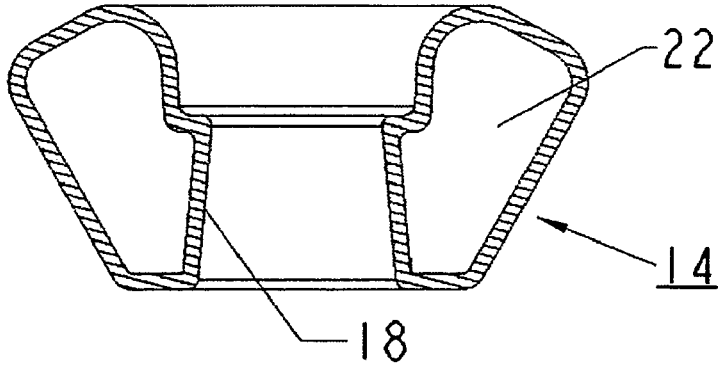
FIG. 4 is a sectional view of the weight collar.

The weighted collar 14 can be seen having a passageway 17 passing therethrough which passageway, as seen in FIGS. 3 and 4, has an annular tapered surface 18, which taper is sized to fit onto the elongated tapered water inlet 13, as shown in FIG. 3, such that the weighted collar taper 18 will fit onto the tapered surface 20 of the elongated water inlet 13 and wedge thereon without quite reaching a flange 21 at the end of the taper 20. This allows the continued vibration and movement of the sprinkler head 10 to further wedge the weighted collar 14 downward onto the tapered surface 20, always maintaining a snug fit to prevent any vibration or movement between the weighted collar 14 and the sprinkler head 10. This prevents wear and tear on both the weighted collar and the sprinkler head.

The weighted collar 14 can be seen having a hollow interior 22, as seen in FIGS. 3 and 4. Also as seen in FIG. 3, the elongated taper water inlet 24 is formed into the sprinkler head 10 upper body portion 11 rather than being removably threaded thereto, as seen in FIGS. 1 and 2. The hollow portion 22 of the weighted collar 14 can be filled with any fluid, granular material but Applicant has found that a granular magnetite or black iron oxide (FE3O4) is an ideal material adding a substantial weight to the collar 14 for the small size of the hollow area 22. This material advantageously reduces the cost of a weighted collar for the sprinkler head over a solid brass or other metal collar and is mounted in a plastic weighted collar 14 so that corrosion is avoided for the weighted collar.

It should be clear that the present invention also contemplates a weighted collar of a solid brass or metal or other weighted collar having an angled bore therethrough sized to be dropped onto and fit onto an annular tapered water inlet of an upper sprinkler body. The present invention is not to be construed as limited to the forms shown which are to be considered illustrative rather than restrictive.

I claim:

1. A sprinkler head having a removable weighted collar comprising:

a sprinkler head body having an upper body portion having an elongated tapered water inlet having a water passageway therethrough, said upper body portion having a nozzle for directing water from said elongated tapered water inlet, and said sprinkler head body having a lower body portion; and said weighted collar having a tapered bore therethrough, said tapered bore being sized to fit over said elongated tapered water inlet and to wedge thereto by the weight of said weighted collar, said weighted collar having a hollow interior filled with a fluid material;

whereby said weighted collar is prevented from moving relative to said elongated tapered water inlet of said sprinkler head body with vibration and movement of said sprinkler head.

2. The sprinkler head in accordance with claim 1 in which said fluid material is a granular material.

3. The sprinkler head in accordance with claim 1 in which said hollow interior weight is filled with said fluid material comprising granular magnetite.

4. The sprinkler head in accordance with claim 3 in which said elongated tapered water inlet has a means for attaching to a water supply pipe.

5. The sprinkler head in accordance with claim 4 in which said tapered bore of said weighted collar is sized to ride on said elongated tapered water inlet to thereby allow a continuing wedging thereon from the vibration of said sprinkler head.

6. The sprinkler head in accordance with claim 5 in which said elongated tapered water inlet is removably attached to said sprinkler body.

7. The sprinkler head in accordance with claim 6 in which said elongated tapered water inlet is removably attached to said sprinkler body with a threaded attachment.

* * * * *